US006425137B1

(12) United States Patent
Fakhrai

(10) Patent No.: US 6,425,137 B1
(45) Date of Patent: Jul. 30, 2002

(54) WRIST BAND

(75) Inventor: Mehdi Fakhrai, 1242 S. Barrington Ave., Apt. #201, Los Angeles, CA (US) 90025

(73) Assignee: Mehdi Fakhrai, Sherman Oaks, CA (US)

( * ) Notice: Subject to any disclaimer, the term of this patent is extended or adjusted under 35 U.S.C. 154(b) by 0 days.

(21) Appl. No.: 09/820,120

(22) Filed: Mar. 27, 2001

(51) Int. Cl.[7] ..... A41D 13/08
(52) U.S. Cl. ..... 2/170; 2/2; 2/338
(58) Field of Search ..... 2/162, 170, 19, 2/311, 312, 338, 16, 59, 23, 24; 224/219, 222, 267, 901, 277, 30 A; 40/904, 586, 665, 633, 1.5, 644

(56) References Cited

U.S. PATENT DOCUMENTS 3,214,852 A * 11/1965 Ford et al. ..... 2/170
5,170,917 A * 12/1992 Tourigny ..... 224/221
5,329,638 A * 7/1994 Hansen et al. ..... 2/16
5,386,933 A * 2/1995 Greene et al. ..... 224/219
5,400,936 A * 3/1995 Jones et al. ..... 224/222
5,454,185 A * 10/1995 Love ..... 224/219
5,704,067 A * 1/1998 Brady ..... 2/170

* cited by examiner

*Primary Examiner*—Gloria M. Hale

(57) ABSTRACT

An apparatus to be worn around an extremity of a user. The apparatus including a body portion, the body portion having at least one pocket, the pocket configured such that the pocket is accessible to the user while the user is wearing the apparatus, the body portion also defining a circumference approximately the circumference of the extremity.

14 Claims, 3 Drawing Sheets

WRIST BAND

FIELD OF THE INVENTION

This invention relates generally to devices for carrying items, and more particularly to devices for carrying items which can be worn by a user. This invention further relates to a method of using such devices.

BACKGROUND

Many devices and methods have been used to hold or carry items. Usually, a bag of some sort is either carried by or strapped on to a user desiring to carry multiple items. In other instances, a user may carry the items in a shirt or pants pocket. However, many of these prior attempts to carry items are either bulky, awkward, ineffective, inconvenient, or have pockets which are inaccessible while being worn by the user. In addition, some of the prior devices fail to address certain activities such as running or exercising, when a user might not have pockets or might not wish to be burdened by a large bag.

Therefore, an unobtrusive device is desired which will enable users to carry items and have access to the items while the device is being worn by the user.

SUMMARY

An apparatus for holding items is disclosed. The apparatus is to be worn around an extremity of a user. The apparatus comprises a body portion, the body portion having at least one pocket, the pocket configured such that the pocket is accessible to the user while the user is wearing the apparatus, the body portion also defining a circumference approximately the circumference of the extremity of the user. Thus, the device could be worn around the user's arm, wrist, leg, or ankle.

In an embodiment, the apparatus comprises a body portion having a first end, a second end, and at least one pocket, the pocket configured such that the pocket is accessible to a user while the user is wearing the apparatus and a fastener for connecting the first and second ends such that the body portion defines a circumference approximately the circumference of the extremity of the user.

In an embodiment, the pockets are closable by any suitable mechanism. For example, the pockets could be closed with a hook-and-loop fastener, a button, a snap, a zipper, or a resilient member.

DESCRIPTION OF THE DRAWINGS

The features, aspects, and advantages of the present invention will become more fully apparent from the following Detailed Description and appended claims when taken in conjunction with the accompanying drawings in which:

DETAILED DESCRIPTION

The present invention overcomes the problems in the existing art described above by providing an unobtrusive device which enables users to carry items, such items still accessible to the user while wearing the device. In the following description, for the purposes of explanation, numerous specific details are set forth in order to provide a thorough understanding of the present invention. It will be apparent, however, to one skilled in the art that the present invention may be practiced without some of these specific details. The following description and accompanying drawings provide various examples for the purposes of illustration. However, these examples should not be construed in a limiting sense as they are merely intended to provide examples of the present invention rather than to provide an exhaustive list of all possible implementations of the present invention.

Figure 1:
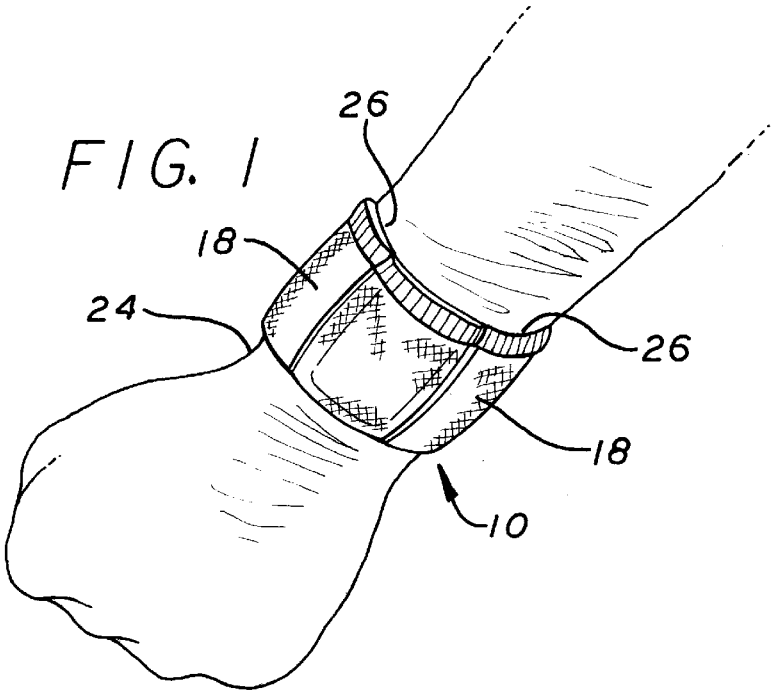
FIG. 1 depicts an embodiment of the invention being worn by a user.
Figure 2:
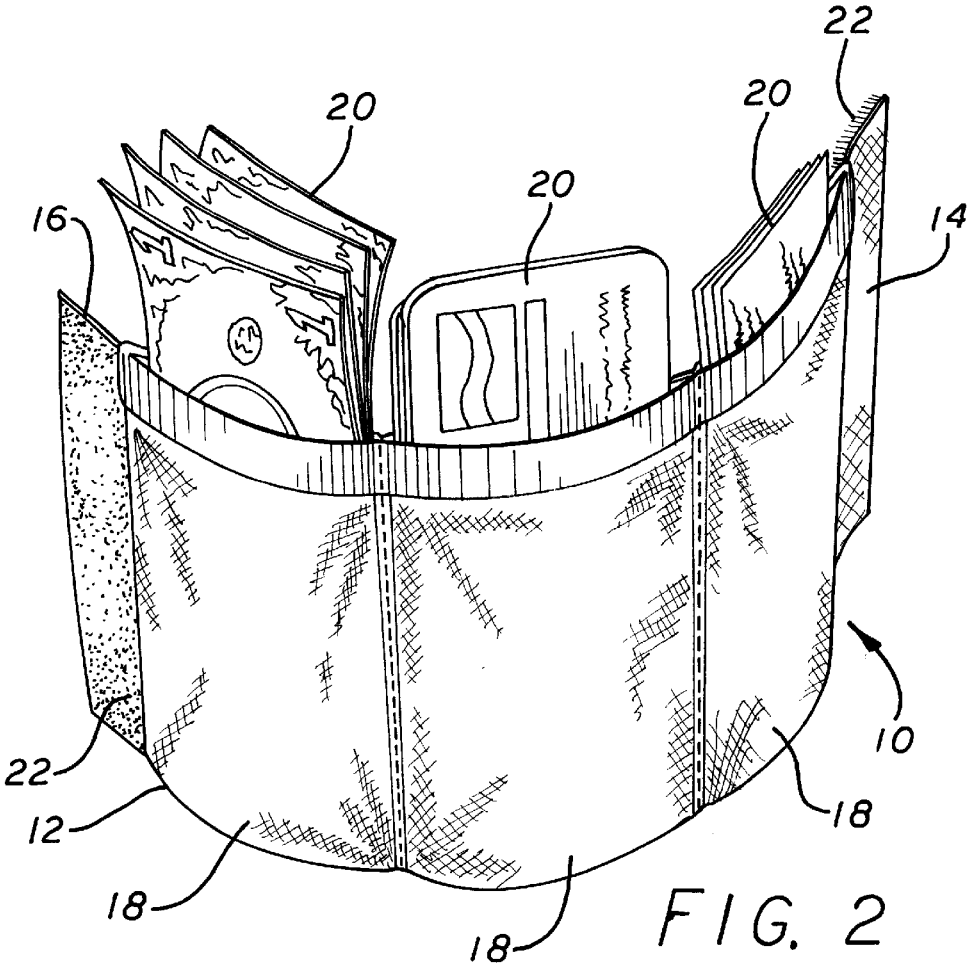
FIG. 2 is a perspective view of an embodiment of the invention having multiple pockets and a hook-and-loop fastener to fasten the invention around the wrist of a user.

Referring to FIG. 2, an embodiment of the device 10 is shown in which the body portion 12 has multiple pockets 18 for holding or carrying items 20. It should be mentioned that the body portion 12 can be made of any fabric or material suitable for holding items 20. The fabric or material contemplated by various embodiments of the invention include, but are not limited to, leather, cloth, plastic, or a combination thereof. In an embodiment, the fabric or material is waterproof to protect the items 20 from getting wet. In an embodiment, the body portion material may be elastic, as well. In addition, although FIGS. 1–4 show an embodiment which has a first end 14 and a second end 16 which are attached around an extremity of a user, it is contemplated by various embodiments of the invention to have a cylindrical body portion which can be slid onto an extremity of a user, with no attachment necessary.

Continuing on with reference to FIG. 2, although multiple pockets 18 are shown, it is within the scope of the present invention to have a device 10 with a single pocket 18. As can be seen, the items 20 may either protrude from or be completely enveloped by the pockets 18. The device 10 also has a first end 14 and a second end 16. In an embodiment, the first end 14 and second end 16 are connected by a hook-and-loop fastener 22. However, any fastener that would effectively hold the first end 14 and second end 16 together is contemplated by the present invention.

Figure 3:
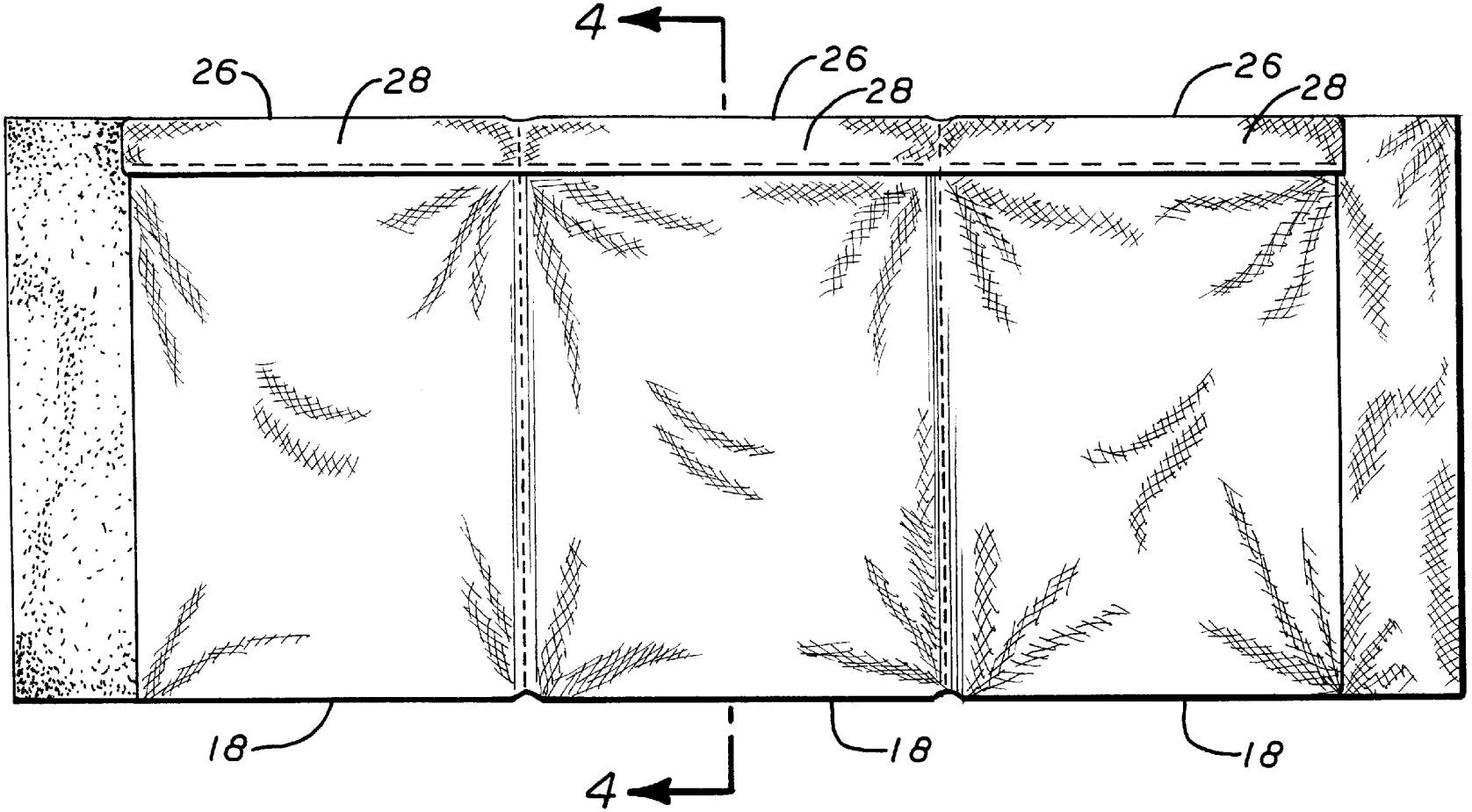
FIG. 3 is a side view of an embodiment of the invention.

FIG. 3 shows that the pockets 18 have openings 26. In an embodiment, these openings 26 are closable by any suitable method. Some examples of closing mechanisms are: friction, hook-and-loop fasteners, buttons, snaps, zippers, or resilient members. The embodiment shown in FIG. 3 utilizes resilient members 28 to close the pocket openings 26. In an embodiment, the resilient members 28 are elastic bands.

Figure 4:
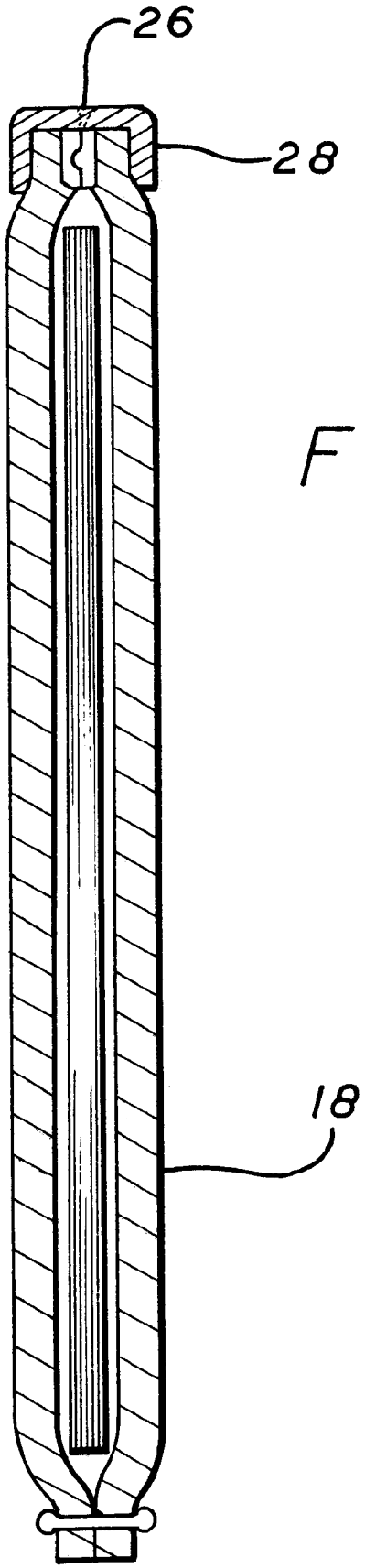
FIG. 4 is a sectional view of one of the pockets shown in FIG. 3.

FIG. 4 is a sectional view of the embodiment shown in FIG. 3. The opening 26 and resilient members 28 are shown.

FIG. 1 shows the device 10 being worn on the wrist 24 of a user. As can be seen, the openings 26 are easily accessible to the user while the device 10 is being worn by the user. Although FIG. 1 shows the device 10 around the wrist 24 of the user, it is also contemplated that the device 10 could be configured to be worn around the leg, arm or any other body part of the user so long as the pocket openings 26 are accessible to the user while the device is being worn by the user. Regardless of where the device is worn on the user's body, the device can be used during numerous activities. Among others, the device could be used during exercise activities when the user is typically wearing clothing without pockets. In addition, the device could be used while the user is swimming or engaged in other aquatic activities. Preferably the device would be made of a waterproof material if the device would be used in such aquatic activities.

It is to be understood that even though numerous characteristics and advantages of various embodiments of the present invention have been set forth in the foregoing description, together with details of the structure and function of various embodiments of the invention, this disclosure is illustrative only. Changes may be made in detail, especially matters of structure and management of parts, without departing from the scope of the present invention as expressed by the broad general meaning of the terms of the appended claims.

I claim:

1. An apparatus to be worn around an extremity of a user, comprising:

a body portion, the body portion having at least one pocket, the pocket having an opening which is closable by at least one resilient member and configured such that the pocket is accessible to the user while the user is wearing the apparatus, the body portion also defining a circumference approximately the circumference of the extremity.

2. The apparatus of claim 1 wherein the body portion is elastically stretchable to vary the circumference defined by the body portion.

3. The apparatus of claim 1 wherein the extremity is an arm.

4. The apparatus of claim 1 wherein the extremity is a leg.

5. An apparatus to be worn around an extremity of a user, comprising:

a body portion having a first end, a second end, and at least one pocket, the pocket having an opening which is closable by at least one resilient member and configured such that the pocket is accessible to the user while the user is wearing the apparatus; and a fastener for connecting the first end and the second end such that a circumference defined by the body portion is approximately the circumference of the extremity.

6. The apparatus of claim 5 wherein the extremity is an arm.

7. The apparatus of claim 5 wherein the extremity is a leg.

8. The apparatus of claim 5 wherein the resilient member is an elastic band.

9. The apparatus of claim 1 wherein the resilient member is an elastic band.

10. An apparatus to be worn around an extremity of a user, comprising:

a body portion, the body portion comprising a waterproof material and having at least one pocket, the pocket having an opening which is closable by at least one waterproof member and configured such that the pocket is accessible to the user while the user is wearing the apparatus, the body portion also defining a circumference approximately the circumference of the extremity.

11. The apparatus of claim 10 wherein the waterproof member comprises an elastic band.

12. The apparatus of claim 10 wherein the waterproof member comprises a zipper.

13. The apparatus of claim 3 wherein the body portion has dimensions suitable to span the length of the arm between a wrist of the arm and an elbow of the arm.

14. The apparatus of claim 4 wherein the body portion has dimensions suitable to span the length of the leg between an ankle of the leg and a knee of the leg.

* * * * *